US005221153A

United States Patent [19]

Spatz

[11] Patent Number: 5,221,153

[45] Date of Patent: Jun. 22, 1993

[54] COSMETIC TESTER

[75] Inventor: Walter B. Spatz, Pacific Palisades, Calif.

[73] Assignee: The Spatz Corporation, Oxnard, Calif.

[21] Appl. No.: 743,153

[22] Filed: Aug. 12, 1991

Related U.S. Application Data

[63] Continuation-in-part of Ser. No. 450,600, Dec. 10, 1989, abandoned.

[51] Int. Cl.[5] ..... A45D 40/26

[52] U.S. Cl. ..... 401/98; 401/88; 401/49; 132/320

[58] Field of Search ..... 401/49, 98, 192, 75, 401/88; 132/320

[56] References Cited

U.S. PATENT DOCUMENTS

| | | | |
|---|---|---|---|
| 2,245,906 | 6/1941 | Deakers | 132/320 X |
| 2,621,786 | 12/1952 | Schnack | 132/320 X |
| 3,332,429 | 7/1967 | Bates | 401/98 X |
| 4,235,557 | 11/1980 | Hayes | 401/49 |
| 4,728,210 | 3/1988 | Barish et al. | 401/88 X |
| 4,794,936 | 1/1989 | Zango | 401/88 X |
| 4,890,944 | 1/1990 | Cousins et al. | 401/98 |
| 4,915,234 | 4/1990 | Boeller | 401/98 X |
| 5,046,875 | 9/1991 | Skolnik | 401/98 X |

FOREIGN PATENT DOCUMENTS

| | | | |
|---|---|---|---|
| 315937 | 5/1989 | European Pat. Off. | 401/88 |
| 2648333 | 12/1990 | France | 401/98 |

*Primary Examiner*—Danton D. DeMille
*Attorney, Agent, or Firm*—Lewis B. Sternfels

[57] ABSTRACT

A cosmetic tester (10, 110, 210, 310, 410) comprises a base (12, 112, 212, 312, 412) and a cap or matrix (14, 414). The base includes a pedestal (18, 418), a support (20, 120, 220, 320, 420) and an intermediate portion (22, 122, 222, 322, 422) which connects the support to the pedestal. A sample (16, 116, 216, 316, 416) of lip creme or other cosmetic, which is configured as a shell, is secured to the support. The matrix/cap is disposed over the shell and includes a tubular wall (32, 432) which is configured to mate closely with the intermediate portion sufficient for essentially preventing passage of any of the sample between the wall and the intermediate portion, but for permitting escape of air therebetween. The matrix terminates in opposed open (34, 434) and closed (36, 136, 436) ends. The closed end is provided with an inner surface (38, 138, 438) in intimate contact with the sample to provide the it with an external surface whose configuration matches that of the matrix's inner surface. The cosmetic tester is constructed by using the matrix as a mold into which a measured quantity of molten cosmetic is placed. The support is then inserted within the matrix and into contact with the molten cosmetic to compression mold it into the shell. After molding, the shell may be spaced slightly from the closed end of the matrix by temporarily forcing ribs (440) beyond a transition (452) in the matrix to produce a resilient force during molding of the shell and thereafter permitting the resilient force alone or by a mechanical separating force between the base (412) and the matrix-cap (414) to slightly move the shell away from contact with the closed end. Alternatively, the cosmetic may be inserted into and between an assembly of the base and the support by injection or transfer molding.

2 Claims, 3 Drawing Sheets

Fig. 8.
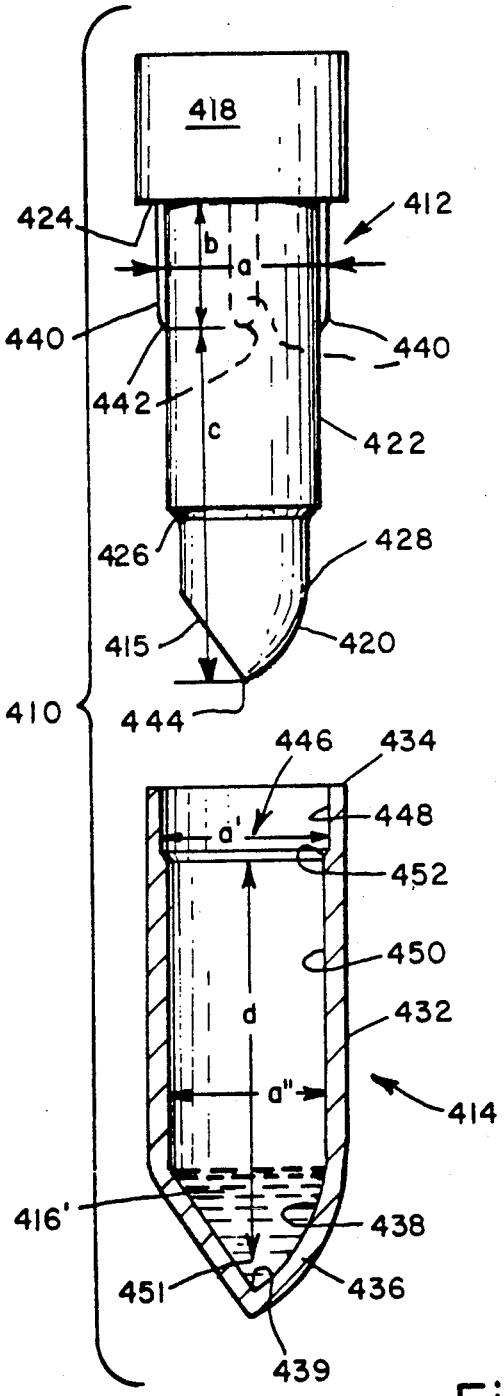
Fig. 9.
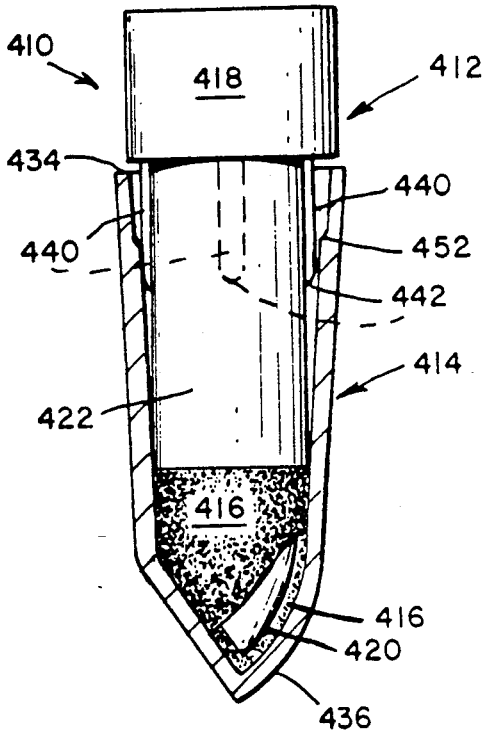
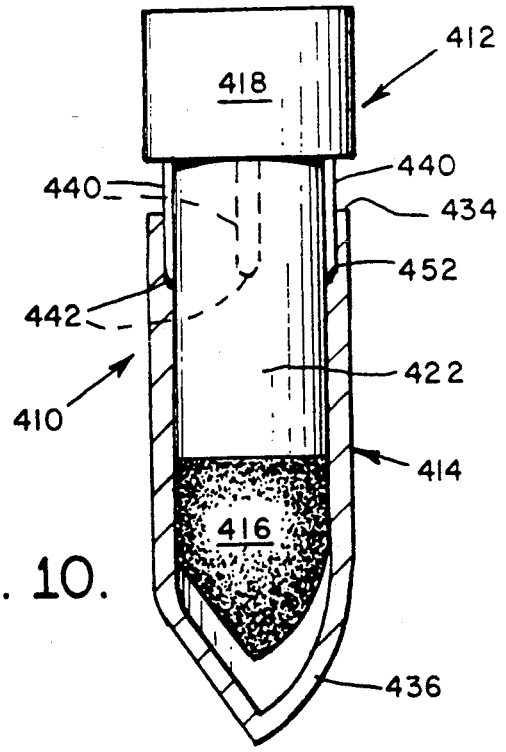
Fig. 10.

COSMETIC TESTER

This is a continuation-in-part of U.S. patent application Ser. No. 07/450,600 filed 10 Dec. 1989 now abandoned.

FIELD OF THE INVENTION

The present invention relates to a cosmetic tester and to the method of its manufacture and, more particularly, to such a tester which is sanitary, disposable and similar in appearance to its consumable equivalent.

DESCRIPTION OF THE PRIOR ART

Cosmetic testers are samplers, such as of lipsticks and eyebrow and lip pencils, which are used to demonstrate cosmetic products to potential customers at the point of sale of their consumable equivalents. A typical tester may comprise a small godet or shallow tray, into which a small quantity or mass of cosmetic, such as lip creme, has been poured, or a spatula for removing a patch of cosmetic from an otherwise salable lipstick or pencil. The customer can then check the color and apply a sample of the cosmetic to her lips or face to determine if it is to her liking.

Such testers are not sanitary, as possibly being contaminated from prior use, which may be offensive to a subsequent customer, who may decline to sample the cosmetic and purchase its consumable equivalent. Further, because of potential problems of sanitation, new government regulations will prohibit the use of such reusable cosmetic testers.

Thus, it has been or will become necessary to use otherwise saleable cosmetic devices, such as lipsticks, for single test use, and thereafter to dispose of them. Such single use is wasteful and costly. Because of the cost, the price of the cosmetics may have to be increased, or the quality decreased. Thus, it is desirable that waste be minimized and costs be kept as low as possible.

Further, it is also desirable to make a customer feel comfortable by using a tester which has the look and feel of the actual product which is for sale.

SUMMARY OF THE INVENTION

The present invention overcomes the aforementioned problems and meets the above-discussed criteria by providing a cosmetic tester which has a base and cap or matrix configured like the cosmetic device to be sold. Specifically, in its preferred embodiment, the base includes a support to which a layer of cosmetic mass is secured, with the cap or matrix placed over the mass.

The cap or matrix is constructed as a mold into which a molten or otherwise moldable mass of cosmetic is placed. The matrix/cap preferably has an internal portion of decreased diameter which is spaced slightly from its entry. The support is shaped as a mandrel and has internal ribs which are sufficiently long to contact the decreased internal diameter portion of the matrix/cap. When the mandrel/support is fully inserted into the matrix/cap to the extent that the rios are forced slightly under the decreased diameter internal portion, a resilient pressure is produced which forces the ribs away from the decreased diameter portion. At the point of full insertion, the mass is forced and configured into a thin shell which adheres more to the support than to the matrix, for which a mold release in the matrix may be used. After solidification of the cosmetic mass, the matrix/cap and the mandrel/support are permitted to slip slightly apart as the ribs are forced out of the decreased diameter internal portion as the resilient pressure therebetween is relieved, to produce and maintain a small gap or separation between the thin shell of cosmetic and the matrix/cap. The end product is then in condition for purposes of consumer use and sampling. Preferably, the cap or matrix is formed of a transparent material, so that the customer can observe the displayed color, without need to remove the cap or matrix. If the color appears acceptable, the cap or matrix may be removed and disposed of, and the small sample applied to the lips or eyes, as applicable. After use, the tester may be discarded.

Thus, in addition to conforming to government regulations forbidding the use of reusable cosmetic testers, the present invention simulates the look and feel of its consumer equivalent, while being simple and inexpensive in construction and manufacture. The seller has an attractive and low cost item for sales appeal, and the potential consumer is provided the ability to view and sample a familiar object.

Other aims and advantages, as well as a more complete understanding of the present invention, will appear from the following explanation of exemplary embodiments and the accompanying drawings thereof.

BRIEF DESCRIPTION OF THE DRAWINGS

FIGS. 8–10 depict a further improved technique for manufacturing a cosmetic tester. FIG. 8 shows an initial step in the manufacture of the cosmetic tester using the preferred technique of compression molding, in which the base of a tester is positioned above the cap or matrix, used as forming mold for the shell of the lip creme, prior to molding of an unmolded mass of the creme to a support portion of the base. FIG. 9 is a view of the matrix and the base fully engaged to form the thin shell of cosmetic. FIG. 10 shows the completed tester and a gap or separation between the cosmetic and the matrix.

DESCRIPTION OF THE PREFERRED EMBODIMENTS

Figure 2:
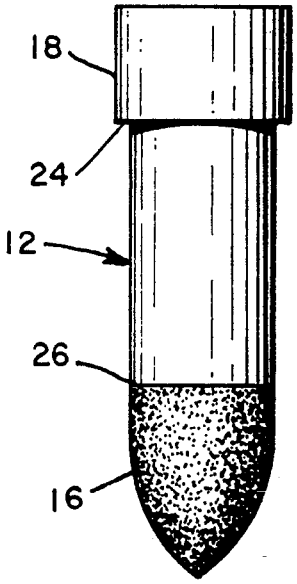
FIG. 2 is an elevational view of the lipstick shown in FIG. 1, with its cap or matrix removed in readiness for application of the creme to the lips.
Figure 1:
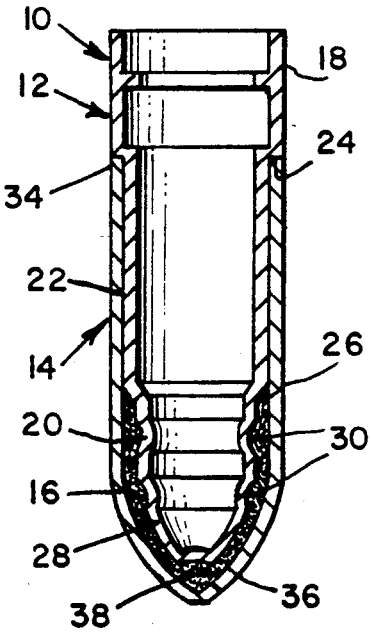
FIG. 1 is a cross-sectional view of a first embodiment of the cosmetic tester of the present invention configured as a lipstick sampler which includes a base, a thin shell of a sample amount of lip creme supported by the base, and a cap or matrix covering the lip creme.

As shown in FIGS. 1 and 2, a cosmetic tester, embodied as a lipstick sampler 10, comprises a base 12, a cap or matrix 14, and a thin shell 16 of a sample of lip creme.

Tester 10 may have a cylindrical, square or other tubular shape, with one or more flats at its tip, to provide an appearance which is like the saleable product so that the potential customer of the product, who is the user of the cosmetic tester, will feel comfortable in handling it.

Figure 3:
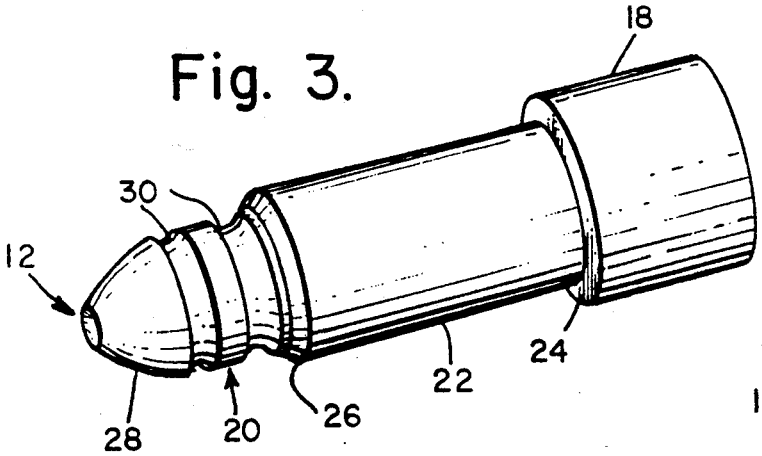
FIG. 3 is a perspective view of the base illustrated in FIG. 1 prior to adhesion thereto of the lip creme.

As also illustrated in FIG. 3, the base includes a pedestal 18, a support 20 and an intermediate portion 22 joining the support to the pedestal at respective transitions 24 and 26. As shown, transition 24 comprises a right-angled downward step from pedestal 18 to intermediate portion 22, while transition 26 is obliquely directed to provide a gradual downward slope from intermediate portion 22 to support 20. Support 20 is configured to provide a surface 28 having a given well-defined, predetermined shape with, if desired, annular depressions 30 therein. Depressions 30 may be used to enable shell 16 of the sample of the lip creme to adhere to support 20 rather to cap or matrix 14.

Cap or matrix 14 includes a tubular portion 32 terminated with an open end 34 and a closed end 36. Closed end 36 has an inner surface 38 which is configured to provide a surface of any desired shape, whether circular or otherwise in cross-section, or chisel-shaped or other given well-defined, predetermined shape. Surface 38 is parallel to and spaced from surface 28 of support 20 in order to provide a space for shell 16. In contradistinction thereto, the facing surfaces of tubular portion 32 of cap or matrix 14 and intermediate portion 22 of base 12 are in close contact with each other so that, when base 12 is inserted into cap or matrix 14, only air and not any of the sample of lip creme can pass between the facing surfaces. A few inwardly directed protuberances 40 enable the cap or matrix to fit tightly to the base.

Figure 4:
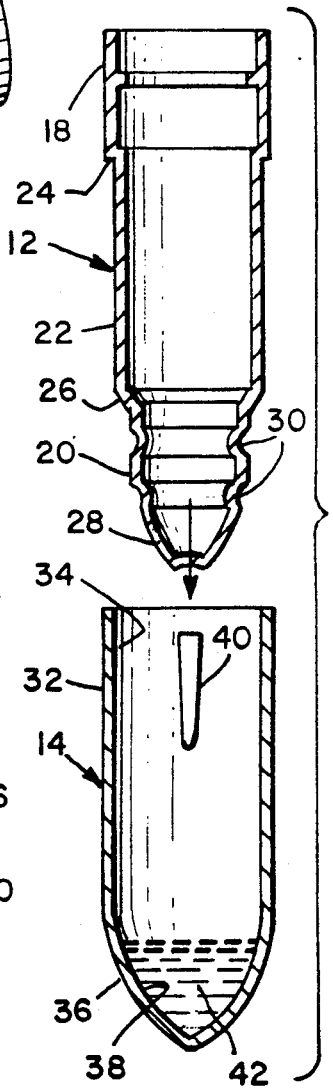
FIG. 4 illustrates a step in the manufacture of the cosmetic tester using the preferred technique of compression molding, depicting the base of FIG. 3 positioned above the cap or matrix which is used as forming mold for the shell of the lip creme, prior to molding of an unmolded mass of the creme to a support portion of the base.

Insertion of a sample into tester 10 is now described with respect to FIG. 4. Cap or matrix 14 is positioned in a holder so that its open end 34 faces upwardly. A small, metered amount or mass 42 of lip creme is placed within the cap or matrix, and may be soft or heated to place it in a moldable condition. Base 12 is then positioned above the cap or matrix and lowered so that support 20 enters the cap or matrix and comes into contact with lip creme mass 42 whose outer surface is thereby molded into the same well-defined, predetermined shape. Insertion of the base into cap or matrix 14 is facilitated by oblique transition 26. Full insertion of the base into the cap or matrix causes mass 42 to form into shell 16 and to be adhered to the support and within annular depressions 30. Air is driven off between the facing surfaces of tubular portion 32 and intermediate portion 22. The amount of mass 42 is selected also not to be extruded beyond the space provided for it.

After the molding of shell 16, it solidifies rapidly due to the thinness of its wall, without requiring any special cooling treatment. If there is any visible shrinkage during cooling, an extra push can be applied to base 12, to drive it deeper into cap or matrix 14 and to take up any empty space. To this end, the base and the cap or matrix are so constructed that a small gap is provided between right-angled transition 24 of the base and open end 34 of the cap or matrix.

Figure 5:
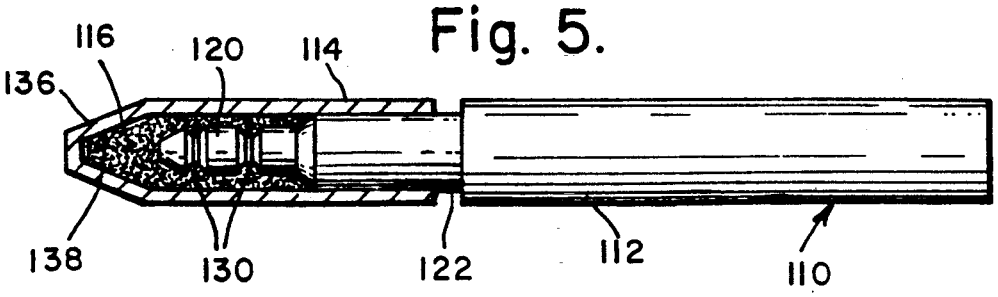
FIG. 5 is a view in partial cross-section showing another embodiment of the present invention configured as a cosmetic pencil.

Referring now to FIG. 5, a cosmetic tester, embodied as a lip pencil sampler 110, comprises a base 112, a cap or matrix 114, and a thin shell of a sample 116 of pencil cosmetic. Sampler 110, like lipstick sampler 10, may have any convenient shape, whether cylindrical, tubular or otherwise, to provide an appearance which is like the saleable product so that the potential customer of the product, who is the user of the cosmetic tester, will feel comfortable in handling it.

In all essential aspects, sampler 110 is identical to sampler 10 of FIGS. 1–4. However, because sampler 110 as configured as a pencil has a smaller cross-section that lipstick sampler 10, case 112 is provided with a support 120 which is generally tubular, but also having annular indentations 130 therein for retaining a sample 116. Cap or matrix 114, like matrix 14, is fitted over a mass and molds it into the desired configuration as determined by interior surface 138 of the matrix.

The above compression molding technique is the preferred method of manufacture, because of its simplicity and relatively low cost. In effect, the molding of the cosmetic and the assembly of the base and the matrix are combined in a single operation. It is to be understood, however, that if molding techniques other than compression molding are used, assembly precedes molding. For example, for injection and transfer molding, the base and the matrix would be first assembled and then filled with the cosmetic. As an aid, one or more openings in the support would be required.

Figure 6:
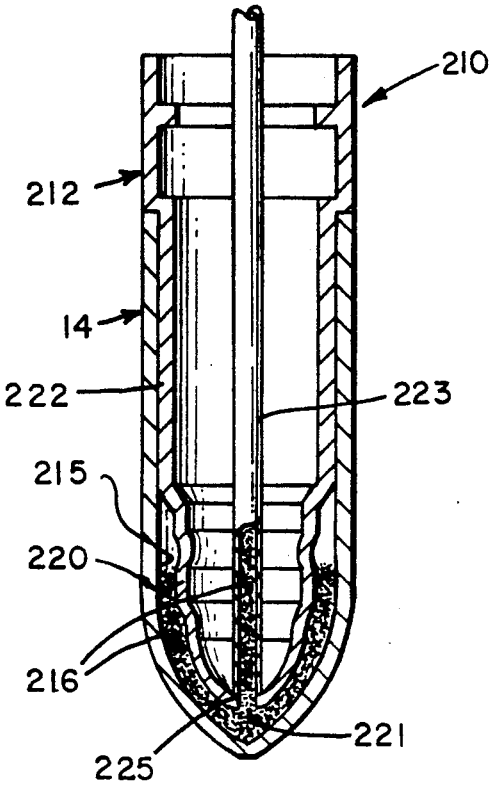
FIGS. 6 and 7 illustrate alternate manufacturing methods respectively of injection and transfer molding.

Specifically, FIG. 6 illustrates an injection molding method for manufacture of a cosmetic tester. This technique uses an assembly 210 comprising a base 212 positioned in matrix or cap 14. The base and the matrix have the same appearance as those depicted in FIGS. 1–4, except that base 212 is provided with a support 220 having a hole 221 therein which opens into a shell-shaped space 215 of desired configuration into which a sample 216 of cosmetic is to be injected. To that end, a tube or needle 223, having a tip 225, is inserted entirely through the interior of base 212 until tip 225 is sealed against hole 221. Cosmetic sample 216 is then injected through needle 223 and hole 221 to fill space 215. As before, air escapes through the space between intermediate portion 222 of base 212 and matrix 14.

Figure 7:
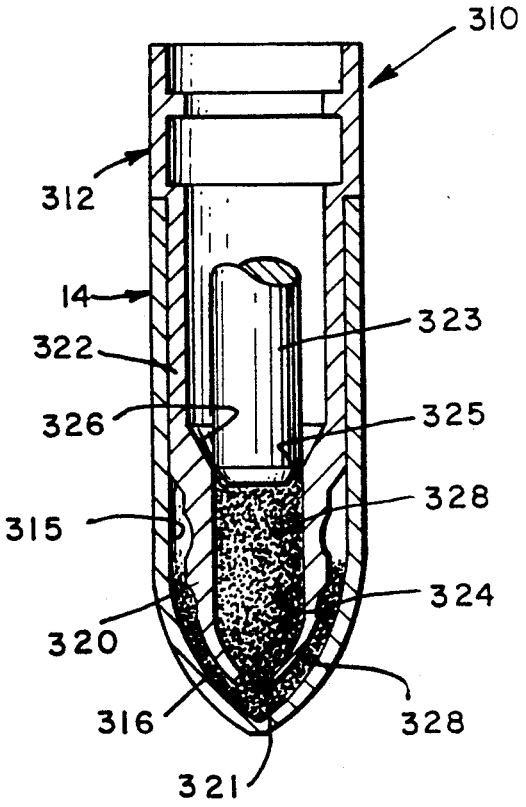

FIG. 7 shows a method for manufacturing a cosmetic tester by transfer molding, in which a tester assembly 310 comprises a base 312 in matrix or cap 14. The base and the matrix are similarly configured as those depicted in FIGS. 1–4, except that base 312 is provided with a support 320 having a hole 321 therein at the end of a cavity 324 with a generally cylindrically-shaped configuration. Cavity 324 opens at a tapered or conical entry 326, and hole 321 opens to a shell-shaped space 315 into which a sample 316 of cosmetic is to be transferred. In operation, a measured amount of cosmetic 328 is placed into cavity 324. A plunger 323, having a tapered end 325, is then inserted through the interior of base 312 into cavity 324, as assisted by the tapering of entry 326 and end 325. Cosmetic material 328 is then extruded through hole 321 to fill space 315. As before, air escapes through the space between intermediate portion 322 of base 312 and matrix 14.

The manufacturing technique shown in FIGS. 8–10 may be employed when there is a concern that the cosmetic may stick to the inside of the matrix FIG. 8 depicts an initial manufacturing step for a cosmetic tester or sampler 410 which includes a base 412 and a cap or matrix 414, between which a thin shell 416 (see FIGS. 9 and 10) of a sample of lip creme is to be formed from a mass 416, thereof (FIG. 8). Tester 410, with one or more flat surfaces 415 at its tip, is given an appearance which is like the saleable product so that it will have sales appeal.

Base 412 comprises a pedestal 418, a support 420 for the cosmetic and an intermediate portion 422 joining the support to the pedestal at respective transitions 424 and 426. As shown, transition 424 comprises a right-angled step from pedestal 418 to intermediate portion 422, while transition 426 is slanted to provide a gradual slope from intermediate portion 422 to support 420. Support 420 is configured with a surface 428 having a given well-defined, predetermined shape.

Cap or matrix 414 includes a tubular portion 432 terminating in an open end 434 and a closed end 436. Closed end 436 has an inner surface 438 which terminates at an apex 439 and which is configured to provide a surface whose shape matches that of surface 428 of base 412. Therefore, surface 438 follows but is spaced from surface 428 of support 420 in order to provide a space for shell 416. However, the facing surfaces of tubular portion 432 of cap or matrix 414 and intermediate portion 422 of base 412 are in close contact with each other so that, when base 412 is inserted into cap or matrix 414, only air and not any of the sample of lip creme can pass between the facing surfaces.

Base 412 is further provided with ribs 440 which are formed on intermediate portion 422 and terminate in ends 442 that slope and merge into portion 422. The ribs are preferably equally spaced about portion 422 and have a cross-sectional dimension a. If intermediate portion 422 is cylindrical, the exteriors of ribs 440 circumscribe a cylinder whose diameter is dimension a. Ribs 440 also extend a predetermined distance b from transition 424 at pedestal 418 to ends 442. In addition, sloping ends 442 are spaced from tip 444 of support 420 by another predetermined distance c.

Matrix 414 is also provided with an interior cavity 446 having a pair of inner surfaces 448 and 450 having respectively larger and smaller dimensions a' and a''. If cavity 446 were cylindrically configured, the dimensions of surfaces 448 and 450 would define diameters a' and a''. Surfaces 448 and 450 are joined by a sloping transition 452. Transition 452 is spaced from a point 451, just short of apex 439 of inner surface 438, by another dimension d. The distance between point 451 and apex 439 is the thickness of cosmetic shell 416.

Dimension a' of larger dimensioned surface 448 is slightly less than dimension a of ribs 440 so that, when base 412 is inserted into matrix 414, ribs 440 have a slight interference fit with surface 448 and, therefore, prevent matrix 414 from slipping too easily from base 412.

Further, dimension c from sloped ends 442 of ribs 440 of base 412 is slightly less than dimension d from transition 452 to end point 451 of matrix 414 so that, when the base is fully inserted into the matrix such that tip 444 of support 420 coincides with matrix point 451, sloped ends 442 of ribs 440 will engage and ride up on transition 452 towards smaller dimensioned surface 450. This engagement between rib ends 442 and transition 452 causes matrix 414 to bulge and to be elastically deformed outwardly, so long as the base is pressed into the matrix or, conversely, to cause base 412 to compress inwardly in an elastic manner. However, upon release of the pressure against the base and, if needed, with the assist of a mechanical force applied between base 412 and matrix/cap 414 to separate one from the other, the resiliency of the matrix and/or the base will urge a camming of base 412 slightly back from matrix 414, as the elastic energy of the base or the matrix at transition 452 is transmitted through rib ends 442 to the base. This separation action is important in the use of the manufactured product and the technique therefor, as described with respect to FIGS. 8–10.

As shown in FIG. 8, cap or matrix 414 is positioned in a holder so that its open end 434 faces upwardly. A release agent may be placed onto surface 438 at closed end 436 of the matrix. A small, metered amount of mass 416' of lip creme is placed within the cap or matrix, and may be soft or heated to place it in a moldable condition.

Base 412 is then positioned above the cap or matrix and lowered so that support 420 enters the cap or matrix and comes into contact with lip creme mass 416'. Insertion of the base into cap or matrix 414 is facilitated by oblique transition 426. As depicted in FIG. 9, the base is pressed sufficiently into the matrix to cause rib ends 442 to ride up on transition 452, at which point creme mass 416' is formed into shell 416 whose outer surface is thereby molded into the same well-defined, predetermined shape. Air is driven off between the facing surfaces of tubular portion 432 and intermediate portion 422. The amount of mass 416' is selected also not to be extruded beyond the space provided for it.

After the molding of shell 416, it solidifies rapidly due to the thinness of its wall, without requiring any special cooling treatment. However, if desired, solidification may be aided by chilling the assembly, such as by a water quench. After solidification, pressure on base 412 is relieved, to enable the base to be cammed slightly backward to form a small gap between the surface of newly formed shell 416 and inner surface 238 of closed end 436. FIG. 10 shows the completed tester and gap or separation between the cosmetic and the matrix.

In use, for all embodiments, a potential customer can inspect and examine the color of the cosmetic seen through the transparent matrix or cap of the sampler. If the tester appears to be of interest, the customer will then remove the matrix/cap and apply the cosmetic to determine if it is, in fact, to the customer's liking.

For non-circular or chisel-shaped tips, the matrix must be keyed to the base at its contact with intermediate portion 22, 122, 222, 322 or 422 or in any other convenient manner to prevent twisting which otherwise would destroy the shape during removal of the cap.

Although the invention has been described with respect to particular embodiments thereof, it should be realized that various changes and modifications may be made therein without departing from the spirit and scope of the invention.

I claim:

1. A method for fabricating a cosmetic tester comprising the steps of:

utilizing a matrix terminating in opposed open and closed ends, which closed end has an inner surface of predetermined configuration;

placing a measured amount of a moldable cosmetic within the closed end and in intimate contact with the matrix inner surface for molding the cosmetic into a shape having an external surface whose configuration matches that of the matrix inner surface;

providing a support with a given, well-defined surface shaped like that of the matrix inner surface;

spacing the support and matrix surfaces apart for configuring the cosmetic layer into a thin shell when the support is inserted within the matrix and into contact with the cosmetic for compression molding the cosmetic into the configuration;

providing the matrix with first and second internal portions of respectively relatively larger and smaller diameters coupled together by a transition, in which the larger diameter first portion is terminated at the open end and the smaller diameter second portion merges into the closed end;

providing the base with external ribs which, with respect to the matrix, (1) are sized to form an interference fit with the larger diameter first portion, and (2) are sufficiently long to contact the smaller diameter second portion, when the base is inserted within the matrix;

fully inserting the base into the matrix under pressure to move the ribs slightly under the smaller diameter second portion and to produce a resilient force tending to move the ribs from the smaller diameter second portion, and thus to force and configure the cosmetic into the thin shell on the support;

solidifying the cosmetic; and relieving the pressure to permit the matrix and the base to slip slightly apart and to urge the ribs to move from the smaller diameter second portion by the resilient force, thereby to produce and maintain a separation between the thin shell of cosmetic and the matrix.

2. A cosmetic tester comprising:

a base including a support having a given well-defined surface for supporting a quantity of cosmetic having an outer surface, a pedestal, and an intermediate portion connecting said support to said pedestal; and a matrix disposed over the cosmetic for functioning as a cap for the tester, said matrix defining a mold having means defining an inner surface of given well-defined, predetermined shape for molding the outer surface of the cosmetic into the same well-defined, predetermined shape, including a tubular wall which is configured to mate closely with said intermediate portion sufficient for essentially preventing passage of any of the cosmetic between said wall and said intermediate portion, but for permitting escape of air therebetween, terminating in opposed open and closed ends, with said mold inner surface being positioned within said closed end and in intimate contact with the cosmetic for configuring the cosmetic with a shape which matches that of said mold inner surface, and said mold inner surface of said closed end being spaced from said support surface for configuring said cosmetic layer into a thin shell, and having first and second internal portions of respectively relatively larger and smaller diameters coupled together by a transition, said larger diameter first portion terminating at said open end and said smaller diameter second portion merging into said closed end; and said intermediate portion having external ribs which, with respect to said matrix, (1) are sized to form an interference fit with said larger diameter first portion, and (2) are sufficiently long to contact said smaller diameter second portion, when said base is inserted within said matrix, whereby, when said base is fully inserted into said matrix, said ribs are forced slightly under said smaller diameter second portion to force and configure the cosmetic into the thin shell on said support and, after solidification of the cosmetic, said matrix and said base are caused to slip slightly apart and said ribs move from said smaller diameter second portion, to produce and maintain a separation between the thin shell of cosmetic and said matrix.

* * * * *